United States Patent [19]

Janay et al.

[11] Patent Number: 4,733,611

[45] Date of Patent: Mar. 29, 1988

[54] MULTIPLE PROJECTILE CARTRIDGE FOR HANDGUNS

[76] Inventors: Michael R. Janay, 12350 Barbee Rd., Bristow, Va. 22013; Richard R. Reuschling, P.O. Box 1121, Manassas, Va. 22110

[21] Appl. No.: 943,144

[22] Filed: Dec. 15, 1986

[51] Int. Cl.[4] ..... F42B 11/00

[52] U.S. Cl. ..... 102/439; 102/438; 102/455; 102/501; 102/506

[58] Field of Search ..... 102/438, 439, 501, 502, 102/506, 491, 455, 448, 457

[56] References Cited

U.S. PATENT DOCUMENTS

| | | | |
|---|---|---|---|
| 15,369 | 7/1856 | Buckel et al. . | |
| 34,806 | 3/1862 | Budd . | |
| 46,292 | 2/1865 | Berdan . | |
| 207,582 | 8/1878 | Wright . | |
| 703,839 | 7/1902 | Scott . | |
| 1,294,059 | 2/1919 | De Case . | |
| 2,440,568 | 4/1948 | Arter . | |
| 2,766,692 | 10/1956 | Mynes | 102/506 X |
| 2,840,944 | 7/1958 | Thompson . | |
| 3,092,026 | 6/1963 | Williams et al. | 102/455 |
| 3,093,073 | 7/1963 | Lockwood et al. . | |
| 3,195,461 | 7/1965 | Freed . | |
| 3,598,057 | 8/1971 | Potter | 102/506 X |
| 3,862,600 | 1/1975 | Tocco . | |

*Primary Examiner*—Harold J. Tudor

*Attorney, Agent, or Firm*—Lowe, Price, Leblanc, Becker & Shur

[57] ABSTRACT

A multiple projectile cartridge for a handgun comprises four spherical projectiles embedded within a paraffin/-powder filler material contained within a plastic casing enclosed in a conventional small caliber shell containing the usual primer assembly and powder charge. The projectiles each have a diameter slightly less than the internal casing diameter which maximizes the number of shots and mass traveling at high velocity to strike the target. The single row of projectiles are longitudinally spaced from each other by the filler material so that the projectiles do not crunch together during flight, resulting in a shot string held together in a close pattern of high ballistic integrity. The diametral relationship (i.e., clearance) between the projectile diameter and internal casing diameter also prevents the plastic casing side wall from laterally expanding as the casing travels through the gun barrel to prevent groove fouling. An optimal mixture of filler material consists of 90% by volume of melted paraffin mixed with 10% by volume of granulated styrofoam. A method of manufacturing the multiple projectile cartridge of the invention is also disclosed.

11 Claims, 2 Drawing Figures

MULTIPLE PROJECTILE CARTRIDGE FOR HANDGUNS

TECHNICAL FIELD

The present application relates generally to multiple projectile cartridges for firearms and, more particularly, to a multiple projectile cartridge containing a load of spherical projectiles therin for use as a small caliber ammunition round for handguns.

BACKGROUND ART

In the war against terrorism, it is more or less recognized by law enforcement and other anti-terrorist agencies that there is a critical range at which to engage a terrorist in many hostage recovery operations. This range is on the order of seven meters, or about twenty-two feet, in which a volume of fire must traverse a closed, short space. In this type of setting, there is an obvious need for some sort of weapon or weapon system to "neutralize" terrorists and to take them out without harming hostages. Conventional small caliber ammunition may be ineffective since the single slug delivered to a target area (i.e., the terrorist) may often be insufficient for "taking out" the terrorist to recover the hostage.

There have been proposed multiple projectile cartridges that deliver multiple slugs to a target area instead of just one. However, numerous problems have plagued the multiple rounds developed over the years. One such problem is that these rounds fail to feature a tight, accurate bullet dispersal pattern, i.e., high ballistic integrity, required for practical use. In other words, at a distance of about seven meters, a tight, accurate bullet dispersal pattern or high ballistic integrity as the term is used herein may be defined as the ability of substantially all the multiple projectiles within the cartridge to hit within an area the size of a three-by-five card so as to provide the tight, accurate bullet dispersal pattern required for practical use.

Equally important as the ability of the multiple projectile round to provide a tight, accurate bullet dispersal pattern to maintain ballistic integrity is the capability of delivering multiple projectiles each having sufficient striking energy to cause injury to the target upon impact.

In a multiple projectile cartridge, tests of good performance include a determination of whether all the projectiles will strike within a given target area at a given range, how hard in terms of pounds of striking energy each projectile will hit the target at a given range, and how short is the "shot string" as measured between the leading projectile and the last projectile in flight at the time the lead projectile strikes the target at a given range. Within the environment of anti-terrorism, it is critical that all the projectiles strike the target area, that each projectile will strike the target with as much energy as possible, and that the shot string be as short as possible so that the projectiles will reach the target at approximately the same time.

In the design of a multiple projectile cartridge and to achieve the foregoing objects, it is necessary to minimize distortion of the individual projectiles as occurs immediately upon firing the cartridge to avoid poor performance. Projectile distortion, and in some instances the welding together thereof as may also occur, is largely attributed to the tremendous force with which each projectile initially presses against its adjacent projectiles as the charge is fired, the pressure being initially exerted on the projectiles nearest the charge and progressively on the remainder of the projectiles in the forward direction. It is generally thought that the rearwardmost projectiles in the string are subjected to greater distortion, and therefore have a greater tendency to disperse from the string upon leaving the gun, and further tend to travel at lower velocity than the more nearly spherical projectiles which are forward thereof, the latter effect tending to lengthen the shot string and reduce the amount of energy with which the projectiles strike the target.

It is accordingly one object of the present invention to provide a muliple projectile cartridge for a handgun in which the mass of the projectiles is optimized so that each projectile strikes the target with high energy and in a tight, accurate projectile dispersal pattern required for practical use.

Another object is to provide a multiple projectile cartridge round having high ballistic integrity.

Another object is to provide a multiple projectile cartridge in the form of .38 cal. and .357 Magnum cal. cartridges discharged from a handgun in a single row shot string having more or less controlled trajectory characteristics in flight to the target.

Another object is to provide a multiple projectile cartridge capable of reliable operation and which does not cause groove fouling.

Another object is to provide a multiple projectile cartridge that may be easily and economically manufactured.

DISCLOSURE OF INVENTION

A multiple projectile cartridge or small caliber ammunition round, in accordance with the present invention, comprises a shell base containing a primer assembly and a predetermined charge of explosive powder into which a casing having multiple spherical projectiles is inserted so as to become integral therewith. The casing is a frangible casing having an interior cylindrical chamber closed at opposite ends thereof. The generally identical spherical projectiles are disposed adjacent each other in the casing interior in a single row having a longitudinal axis generally coincident with the longitudinal axis of the cartridge. Each projectile has a diameter slightly less than the diameter of the chamber. The projectiles are embedded within one of a wax mixture or a powder.

The wax mixture preferably consists of a mixture of about 85–95% by volume of paraffin to about 5–15% by volume of granulated styrofoam dispersed within the paraffin. The casing is substantially entirely filled with the wax mixture which fills the interstices between adjacent projectiles as well as a clearance defined between the projectiles and the casing interior side wall.

The cartridge is preferably a small ammunition round such as a .357 Magnum or .38 cal. for use in a small handgun. The frangible casing is a plastic capsule closed at opposite ends thereof by means of plastic end walls and one of the walls is a plastic end cap press-fitted into position after the projectiles and filler material are deposited into the capsule.

In accordance with the present invention, a method of manufacturing the multiple projectile round of handgun ammunition is also disclosed. The method comprises the steps of preparing a cartridge base with a primer assembly and a charge of gun powder. Next, a plastic capsule or casing open at one end thereof is positioned in an upright position, a predetermined quantity of granulated styrofoam is placed at the bottom of the capsule interior, and plural spherical projectiles are dropped in seriatim into the casing interior. The diameter of each projectile is slightly less than the inside diameter of the casing such that the projectiles are disposed in a single row. Next, melted paraffin is injected into the casing interior by a syringe with the granulated styrofoam initially placed at the bottom of the casing interior being gradually mixed with the injected melted paraffin. The paraffin tends to retain the projectiles in the single row until the cartridge is fired and also longitudinally spaces adjacent projectiles from each other to prevent the adjacent projectiles from crunching or welding together upon firing of the cartridge. The open end of the casing is then capped upon completion of filling the casing interior with the projectiles and filler materials. The capped end is then inserted into the open end of the cartridge base until the capped end contacts the primer assembly. Then, the edges of the open end of the cartridge base are crimped against the exterior side wall of the casing to complete the round.

Additional objects, advantages and other novel features of the present invention will become apparent from the foregoing and in part from the description which follows.

BEST MODE FOR CARRYING OUT THE INVENTION

Figure 1:
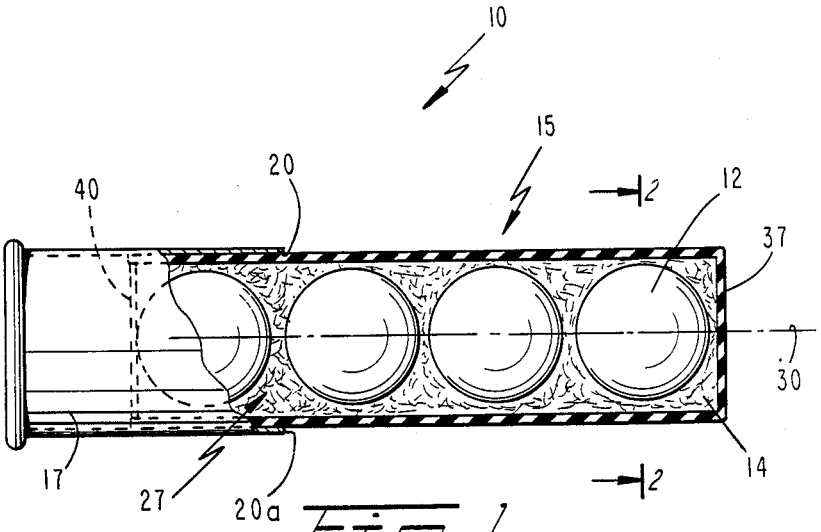
FIG. 1 is a detailed cross-sectional side view of a multiple projectile cartridge in accordance with the present invention.
Figure 2:
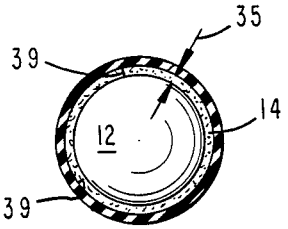
FIG. 2 is a sectional view taken along the line 2—2 of FIG. 1.

Reference is now made to FIGS. 1 and 2, wherein the multiple projectile cartridge 10 of the present invention can be generally seen to comprise a series of four spherical projectiles or slugs 12 embedded within a unique filler material 14 contained within a frangible plastic capsule or casing 15. The capsule 15 is enclosed in a conventional small caliber shell 17, such as a .38 cal. or a .357 Magnum round, containing the usual primer assembly and a powder charge (not shown in detail). The capsule 15 is held in position following insertion into the open end 20 of shell 17 by crimping or inwardly turning the edges 20*a* (defining said open end) against the exterior surface of the casing.

The illustrated multiple projectile cartridge 10 of the invention is a .38 cal. cartridge that delivers four slugs or projectiles 12 to a target area instead of one projectile. However, the technology described herein is transferable to other small caliber ammunition used in a revolver or handgun. By extensive experimentation and development, it has been achieved that substantially all the shots fired from cartridge 10 tend to, if not consistently, hit within an area the size of a three-by-five inch card at seven meters, or about twenty-two feet, which is considered to be a critical, often encountered range at which terrorists are engaged, with handguns in a hostage recovery operation. The cartridge 10 of the invention, as discussed infra, is characterized by a unique combination of features which result in the tight, accurate bullet dispersal pattern, ballistic integrity, required for practicable use.

It is an important feature of the present invention that spherical projectiles 12 be disposed within the cylindrical casing interior region 25 of frangible casing 15 to form a single row 27 having a longitudinal axis 30 generally coincident with the longitudinal axis of the cartridge 10. This is achieved by reason of the diameter of each projectile 12 which is only slightly less than the internal diameter of the casing 15. By forming the projectiles 12 in this manner, the resulting shot string or row 27, upon firing the cartridge, tends to travel in a close pattern during flight so as to achieve the high ballistic integrity discussed supra. In addition, and advantageously, the aforesaid diametral relationship optimizes the mass of each projectile 12 which is a highly significant factor in how hard in terms of foot pounds of striking energy each projectile will hit the target at a given range. In other words, each projectile 12 will strike the target area with high energy and, because of the filler material 14 discussed below, the shot string will be as short as possible so that more of the projectiles will reach the target at approximately the same time although the projectiles will remain longitudinally spaced from each other so that the shot string doesn't crunch together.

Although a precise diametral relationship between the projectile diameters and the casing internal diameter is not entirely known, one example of the present invention prefers the use of four of No. 3-0 buckshot in the manufacture of a multiple projectile cartridge 10 of .38 cal. It is important that a more or less annular clearance (FIG. 2) 35 be maintained between each spherical projectile and the interior of tubular casing 15. This is because as the frangible plastic casing 15 travels through the gun barrel upon firing of the cartridge with the shot string 27 remaining more or less intact within the casing, the plastic casing actually begins to disintegrate because of the tremendous forces and heat acting thereon, which disintegration is completed after the plastic casing and shot string exit the gun barrel. However, it has been found, by extensive experimentation, that if the projectile diameter is sufficiently large so as to result in the projectiles contacting the interior of the casing wall, the consequent distortion of the projectiles upon firing the cartridge tends to cause the plastic casing side wall to experience lateral expansion against the grooves and lands within the gun barrel which causes "groove fouling". By forming the projectile diameter so as to obtain the clearance 35, any distortion of the projectiles upon firing the cartridge tends to occur within the clearance 35 without causing lateral expansion of the plastic casing side walls into the grooves of the gun barrel.

From the foregoing, it can be seen that the desired arrangement of projectiles 12 contemplated by the present invention is somewhat critical. However, from the foregoing description, it will now be generally understood that the multiple projectile cartridge 10 of the present invention can be manufactured for use in revolvers or handguns having barrels of different caliber, respectively, so long as the projectile diameters are sufficient to result in a shot string arranged in a single row with a slight clearance provided between the projectiles and the interior of the casing wall. It is generally considered to be unsatisfactory to have the projectiles loaded in criss-cross fashion within the casing or in more than a single row. As a general rule, the projectile diameters are selected so that the single row or shots 27 within casing 15 will result without depending upon the use of filler material 14 for suspending said projectiles in a single row by embodiment within the filler material. In other words, the single row should occur as a function of the diametral relationship upon loosely stacking the projectiles 12 within casing 15. Generally, therefore, the diameter of each projectile 12 should be preferably approximately 80–95% of the interior diameter of casing 15 to obtain said single row.

The plastic capsule or casing 15, as discussed above, is believed to remain intact until after it leaves the muzzle at which time the tremendous explosive forces and heat occurring as a result of firing the cartridge causes the casing to disintegrate so that the shot string 27 may travel to strike the target. Casing 15 is conventional and commercially available as a shot shell casing albeit for a different use than that provided by the present invention. Casing 15 is a plastic cylindrical member having an end wall 37 at one end thereof defining a base. This end 37 which in cartridge 10 will form the forward end of the cartridge includes radial serrations 39 which tend to weaken the end wall causing the casing to disintegrate after leaving the gun barrel. The rear end of casing 15, following manufacture of cartridge 10 as discussed below, is closed with a plastic end cap 40 press-fitted into the rear end. Following this step, the plastic capsule 15 is loaded into the open end of shell 17 by insertion into said open end until the press-fitted end cap contacts the powder charge and primer assembly previously and conventionally positioned within the shell. The edges 20*a* of the shell 17, as discussed supra, are then crimped against the plastic casing 15 to complete the cartridge assembly.

In the manufacture of a .38 cal. cartridge, approximately four grains of powder charge are placed within the shell 17 during the manufacturing process. For a .357 Magnum cartridge, about four and one-half grains are used; for a .44 Magnum cartridge, about six grains are used. In accordance with one aspect of the invention, it is preferred to use Bullseye pistol powder, commercially available, which is a highly explosive powder that will result in a muzzle exit velocity of projectiles 12 in the range of 1350–1500 feet per second (fps), making this a sonic multiple projectile. Capabilities exist to make this multiple projectile ammunition into a subsonic/silenced mode as will now occur to one skilled in the art upon examination of this application. This exit velocity is considerably greater than the exit velocity of other known projectiles and results in a considerably greater amount of multiple sequential projectile energy striking and tending to destroy the target. This type of fire power is highly preferred in an anti-terrorist (i.e., hostage recovery) situation. Notwithstanding the high exit velocities supra, cartridge 10 and in particular projectiles 12 therein are advantageously constructed to avoid any considerable distortion of the spherical projectiles upon firing the cartridge so that the projectiles have high ballistic integrity during flight by remaining together in a close pattern with the projectiles longitudinally spaced one adjacent the other in stable trajectory.

The purpose of filler material 14 is to assist in maintaining the shot string 27 both in a single row with projectiles 12 in longitudinally spaced relationship to each other so that the shot string, during flight, is maintained together in a close pattern to achieve high ballistic integrity and to also prevent the shot from crunching together when the cartridge is initially fired through the barrel. In accordance with the present invention, filler material 14 preferably consists of 85–95% by volume of paraffin and 5–15% by volume of granulated styrofoam having a consistency similar to granulated white sugar.

Based upon extensive experimentation, it has been found that the foregoing mixture of paraffin and granulated styrofoam is highly preferred over pure paraffin or a pure powdered styrofoam or other powdered filler material. Although the actual action of the paraffin/-granulated styrofoam filler in enhancing the performance of the spherical projectiles 12 upon discharge is not known, it is thought that the granulated styrofoam essentially imparts spring-like characteristics to the paraffin filling the interstices between the projectiles and interior casing wall while the paraffin itself acts as a binder agent for maintaining the shot string projectiles in a single row as the projectiles travel at high velocity through the gun barrel upon discharge of the firearm. In other words, projectile distortion and welding together of adjacent projectiles as occurs immediately upon firing a prior art cartridge, is a highly significant factor regarding poor performance in the sense that the tremendous force with which each projectile initially presses against its adjacent projectile as the charge is fired results in a tremendous pressure being initially exerted on the projectiles nearest the charge and progressively on the remainder of the projectiles in the forward direction. It is thought that the rearwardmost projectiles in the string are subjected to greater distortion, and therefore, have a greater tendency to disperse from the string upon leaving the gun, and further tend to travel at lower velocity than the more nearly spherical projectiles which are forward thereof, the latter effect tending to lengthen the shot string and reduce the amount of energy with which the projectiles strike the target. However, the filler material 14 of the present invention essentially enables the granulated styrofoam to impart spring-like characteristics to the filler material so that these tremendous forces are more uniformly transmitted to each projectile in the shot string with the result that the spherical projectiles tend to accelerate (upon firing the cartridge) at an even rate relative to each other so that the projectiles remain generally spherical and without excessive loss of energy with which the projectiles strike the target. It is theorized that pure paraffin as a filler material, although satisfactory for longitudinally spacing the projectiles from each other in the casing, does not have the necessary spring-like characteristics desirable for achieving the trajectory characteristics discussed above. Similarly, a pure powder or granulated filler material may allow for movement of the projectiles within the casing prior to firing, i.e., a pure powder or granulated material may allow adjacent projectiles to touch and possibly weld together during firing.

Multiple projectile cartridge 10 of the present invention may be manufactured in the following manner. Considering the plastic casing 15 as being stood upight on its end 37, the casing interior chamber is loaded by first placing a predetermined quantity of the granulated styrofoam in the bottom of the interior chamber and then placing the four projectiles 12 thereon by dropping the projectiles into the casing open end one on top of the other. Next, a syringe (e.g., a 3 cc. syringe) preferably provided with an 18 gauge needle is utilized to draw approximately $\frac{3}{4}$ cc. of melted paraffin into the syringe barrel. The syringe needle is then inserted into the casing interior through the open end thereof until the needle is positioned at the bottom or base of the casing interior by passing the needle through the clearance between the spherical projectiles and interior casing wall. While preferably maintaining the needle at the bottom, the syringe plunger is then depressed to gradually dispense the melted wax to completely fill the interstices between the spherical projectiles and the interior casing wall.

As the melted paraffin is dispensed into the casing bottom as aforesaid, it mixes with the granulated styrofoam and tends to uniformly disperse the styrofoam granules throughout the casing interior. Upon completion of filling the interstices and clearance with filler material 14, the syringe is removed and plastic end cap 40 is press-fitted into the open end of the casing 15 to close the casing interior. In this manner, the shot string 27 of projectiles 12 formed in a single row is embedded within the filler material to achieve the desired trajectory characteristics upon firing of the cartridge at a latter time. The assembled capsule 15 is then secured to the shell 17 as discussed above to complete the multiple projectile cartridge of the invention.

It is within the scope of the present invention to uniformly mix the granulated sytrofoam with the melted paraffin prior to injecting the latter by syringe into the casing interior. In addition, although preferred, the syringe may be substituted by other means for placing the premixed melted paraffin and granulated styrofoam into the casing interior. However, the foregoing method involving initial placement of the granulated styrofoam at the bottom of the casing interior followed by injection of melted paraffin into the interior is preferred since it is theorized that uniform mixing of granulated styrofoam with the melted injected paraffin throughout the casing interior may not occur and, in fact, it is theorized that there may be a greater concentration of granulated styrofoam within the filled casing located towards the open end of casing 15 which open end will ultimately be located closest to the primer assembly and powder charge where, upon firing of the cartridge, the explosive force is greatest and projectile deformation is most likely to occur. In other words, it is theorized that the heavier concentration of styrofoam granules in this area of the casing interior essentially functions as a spring to uniformly distribute the explosive force upon firing of the cartridge although the exact performance and distribution of the granulated styrofoam within the melted paraffin is not exactly known.

The invention may be embodied in other specific forms without departing from the spirit or essential characteristics thereof. The present embodiment is therefore to be considered in all respects as illustrative and not as restrictive, the scope of the invention being indicated by the appended claims rather than by the foregoing description, and all changes which come within the meaning and range of equivalency of the claims are therefore intended to be embraced therein.

What is claimed is:

1. A small caliber multiple projectile ammunition round or cartridge, comprising a base containing a primer assembly and a predetermined charge of explosive powder; a frangible casing having an interior cylindrical chamber closed at opposite ends thereof, and a shot column within the chamber comprising a plurality of laterally identical spherical projectiles disposed adjacent and spaced from each other in the casing in a single row having a longitudinal axis generally coincident with the longitudinal axis of said cartridge, each projectile having a diameter less than the diameter of the chamber, said projectiles being substantially entirely embedded within a filler material which maintains each projectile spaced from and out of contact with the casing and with adjacent projectiles, said filler material being a wax mixed with a granulated material.

2. The cartridge of claim 1, wherein said filler material is a wax mixture consisting of a mixture of about 85–95% by volume of paraffin to about 5–15% by volume of granulated styrofoam uniformly dispersed within the paraffin.

3. The cartridge of claim 2, wherein said casing is substantially entirely filled with said wax mixture consisting of approximately 90% by volume of paraffin to approximately 10% by volume of granulated styrofoam.

4. The cartridge of claim 3, wherein four spherical projectiles are disposed within said casing to define said single row.

5. The cartridge of claim 4, wherein said cartridge is a .38 cal. cartridge and each projectile is one of No. 1-0 or 3-0 buckshot.

6. The cartridge of claim 5, wherein said predetermined charge of explosive powder is about 4 grains.

7. The cartridge of claim 3, wherein said cartridge is a 0.357 Magnum cal. cartridge and said predetermined charge explosive powder is about 4.5 grains.

8. The cartridge of claim 1, wherein said frangible casing is a plastic capsule closed at opposite ends thereof by means of plastic end walls, one of said walls being a plastic end cap press-fitted into position.

9. The cartridge of claim 8, wherein said plastic capsule is a shot shell casing.

10. The cartridge of claim 1, wherein said granulated material is substantially homogeneously mixed within said wax.

11. The cartridge of claim 1, wherein said granulated material is mixed within said wax to have a greater concentration of granulated material closer to the primer assembly and a lesser concentration in a direction away from the primer assembly.

* * * * *